US010783739B2

(12) United States Patent
Sumi et al.

(10) Patent No.: US 10,783,739 B2
(45) Date of Patent: Sep. 22, 2020

(54) PUSH-BUTTON FOR GAME MACHINE

(71) Applicant: OMRON Corporation, Kyoto (JP)

(72) Inventors: Masaaki Sumi, Gifu (JP); Takehiro Agata, Aichi (JP); Hiroyuki Onitsuka, Gifu (JP); Junya Fujita, Aichi (JP)

(73) Assignee: Omron Corporation, Kyoto (JP)

( * ) Notice: Subject to any disclaimer, the term of this patent is extended or adjusted under 35 U.S.C. 154(b) by 119 days.

(21) Appl. No.: 16/165,405

(22) Filed: Oct. 19, 2018

(65) Prior Publication Data

US 2019/0147690 A1 May 16, 2019

(30) Foreign Application Priority Data

Nov. 13, 2017 (JP) ..... 2017-218288

(51) Int. Cl.

| | |
|---|---|
| ***G07F 17/00*** | (2006.01) |
| ***G07F 19/00*** | (2006.01) |
| ***G07F 17/32*** | (2006.01) |
| ***F21V 13/04*** | (2006.01) |

(52) U.S. Cl.
CPC ..... *G07F 17/3209* (2013.01); *F21V 13/04* (2013.01)

(58) Field of Classification Search
CPC ..... G07F 17/3209; H01H 13/023
See application file for complete search history.

(56) References Cited

U.S. PATENT DOCUMENTS 6,102,394 A * 8/2000 Wurz ..... G07F 17/32 200/296
2004/0074751 A1* 4/2004 Watanabe ..... H01H 13/023 200/310
2004/0118669 A1* 6/2004 Mou ..... H01H 9/12 200/310
2004/0256210 A1* 12/2004 Morita ..... H01H 3/122 200/344
2006/0166728 A1* 7/2006 Cornell ..... G07F 17/32 463/16
2007/0060291 A1* 3/2007 Cole ..... G07F 17/32 463/20
2008/0113707 A1* 5/2008 Nesemeier ..... G06F 3/0202 463/16
2009/0218207 A1* 9/2009 Mou ..... H01H 13/52 200/334
2010/0323791 A1* 12/2010 Kim ..... G07F 17/3209 463/30

(Continued)

FOREIGN PATENT DOCUMENTS

JP 2007-317380 A 12/2007

*Primary Examiner* — Milap Shah
(74) *Attorney, Agent, or Firm* — Osha Liang LLP

(57) ABSTRACT

A push-button for a game machine which is mounted on the game machine includes an operation key configured to accept a press, a side surface portion having translucency and provided in a direction vertical to a pressing direction of the operation key as viewed from the operation key, a light source configured to apply light in a direction parallel to the pressing direction, and a light guiding portion configured to guide light applied from the light source. The light guiding portion includes a first reflective structure configured to reflect at least a part of the light applied from the light source, and a second reflective structure configured to reflect at least a part of the light reflected by the first reflective structure toward the side surface portion.

16 Claims, 11 Drawing Sheets

(56) References Cited

U.S. PATENT DOCUMENTS

| | | | | |
|---|---|---|---|---|
| 2011/0269543 | A1* | 11/2011 | Johnson | G07F 17/3209 463/37 |
| 2014/0094308 | A1* | 4/2014 | Lesley | A63F 13/02 463/37 |
| 2014/0179429 | A1* | 6/2014 | Okazaki | G07F 17/3209 463/31 |
| 2014/0197015 | A1* | 7/2014 | Ikeuchi | H01H 13/023 200/314 |
| 2015/0034468 | A1* | 2/2015 | Hwa | H01H 13/7065 200/5 A |
| 2015/0094148 | A1* | 4/2015 | Sumi | G07F 17/3209 463/37 |
| 2016/0335845 | A1* | 11/2016 | Onoyama | G07F 17/3209 |
| 2018/0056177 | A1* | 3/2018 | Sakamoto | A63F 9/24 |
| 2018/0075691 | A1* | 3/2018 | Sumi | G07F 17/3213 |
| 2019/0080549 | A1* | 3/2019 | Lewis | G06F 3/0202 |

* cited by examiner

PUSH-BUTTON FOR GAME MACHINE

CROSS-REFERENCE TO RELATED APPLICATION

This application is based on Japanese Patent Application No. 2017-218288 filed with the Japan Patent Office on Nov. 13, 2017, the entire contents of which are incorporated herein by reference.

FIELD

The present invention relates to a push-button for a game machine to cause a side surface of the push button to emit light.

BACKGROUND

In game facilities like casinos, game machines such as slot machines are installed. In the game facilities, not only slot machines manufactured by a single game machine manufacturer but also slot machines manufactured by various game machine manufacturers are installed. A player selects a slot machine meeting his or her preference among the slot machines manufactured by various game machine manufacturers and plays a game. Hence in the game facilities, a slot machine popular with players is installed to ensure superiority over other competing game facilities. For example, as disclosed in Japanese Unexamined Patent Application Publication No. 2007-317380 (published on Dec. 6, 2007), a push-button mounted on a slot machine has been caused to emit light so that the slot machine appeals to the player. In the technique disclosed in Japanese Unexamined Patent Application Publication No. 2007-317380, light from a light emitting element is applied to an operation surface through a diffusion sheet to cause the operation surface to emit light.

However, in the technique disclosed in Japanese Unexamined Patent Application Publication No. 2007-317380, since natural diffusion by the light emitting element is mainly performed and, furthermore, the diffusion sheet as a diffusion assisting member is used, the distance from the light emitting element to the operation surface becomes long. This has caused a problem of increasing the thickness of the push-button.

SUMMARY

An object of one aspect of the present invention is to achieve provision of a push-button for a game machine capable of causing a side surface of the push button to emit light, without increasing a thickness of the push-button.

In order to solve the above problem, a push-button for a game machine according to an aspect of the present disclosure is a push-button for a game machine which is mounted on the game machine and includes: an operation key configured to accept a press; a side surface portion having translucency and provided in a direction perpendicular to a pressing direction of the operation key as viewed from the operation key; a light source configured to apply light in a direction parallel to the pressing direction; and a light guiding portion configured to guide light applied from the light source. The light guiding portion includes a first reflective structure configured to reflect at least a part of the light applied from the light source, and a second reflective structure configured to reflect at least a part of the light reflected by the first reflective structure toward the side surface portion.

With the above configuration, the light guiding portion guides light in the direction parallel to the pressing direction to cause the side surface portion to emit light. It is thereby possible to cause the side surface portion to emit light without increasing the thickness of the push-button for the game machine in the pressing direction. Further, since the light guiding distance from the light source to the side surface portion can be made long, the light can be applied to the side surface portion, having a large length perpendicular to the pressing direction, over a wide range.

In a push-button for a game machine according to an aspect of the present disclosure, the first reflective structure may reflect at least a part of the light applied from the light source in a direction parallel to the side surface portion and perpendicular to the pressing direction, and the second reflective structure may be disposed in a direction parallel to the side surface portion and perpendicular to the pressing direction with respect to the first reflective structure.

With the above configuration, it is possible to spread the light emitted from the light source in the direction parallel to the side surface portion and then to reflect the light toward the side surface portion. As a result, the light can be applied to the side surface portion, having a large length perpendicular to the pressing direction, over a wide range.

In a push-button for a game machine according to an aspect of the present disclosure, it is preferable that in a light irradiation region to which the light is applied from the light source, the first reflective structure be provided in a partial region being smaller than the light irradiation region and including an optical axis center of the light emitted from the light source.

With the above configuration, among the light emitted from the light source, light having not been applied to the first reflective structure is applied to the side surface portion in the vicinity of the light source. As a result, a part of the light emitted from the light source is reflected by the second reflective structure and emitted from the side surface portion to an outside, and the other light emitted from the light source is applied to the side surface portion in the vicinity of the light source. It is thereby possible to cause the side surface portion to emit light uniformly.

In a push-button for a game machine according to an aspect of the present disclosure, it is preferable that the second reflective structure include a first reflective surface and a second reflective surface, and the first reflective surface and the second reflective surface reflect the light reflected by the first reflective structure in an identical direction, and have mutually different distances from the first reflective structure.

With the above configuration, the wide range of the side surface portion can be caused to emit light in the direction perpendicular to the pressing direction.

In a game machine push-button according to an aspect of the present disclosure, a plurality of the first reflective structures may be provided, and only one second reflective structure may be provided between two of the first reflective structures adjacent to each other.

With the above configuration, it is possible to make the light guiding portion structurally simple, as compared to the case of providing a plurality of reflective structures for reflecting the light reflected by the first reflective structure toward the side surface portion.

In a push-button for a game machine according to an aspect of the present disclosure, it is preferable that the side surface portion diffuse the light reflected by the second reflective structure and apply the light to an outside.

With the above configuration, the light reflected by the second reflective structure is diffused and applied to the outside. It is thereby possible to cause the side surface portion to emit light more uniformly.

According to an aspect of the present invention, it is possible to achieve provision of a push-button for a game machine capable of causing a side surface of the push button to emit light, without increasing a thickness of the push-button.

DETAILED DESCRIPTION

First Embodiment

Hereinafter, an embodiment according to an aspect of the present disclosure (hereinafter also referred to as "the embodiment") will be described with reference to the drawings. In the embodiment, a push-button 1 as an aspect of a push-button for a game machine in the present disclosure will be described. The push-button 1 is the push-button for the game machine which is mounted on a game machine such as a slot machine.

§ 1 Application Example

Figure 1A:
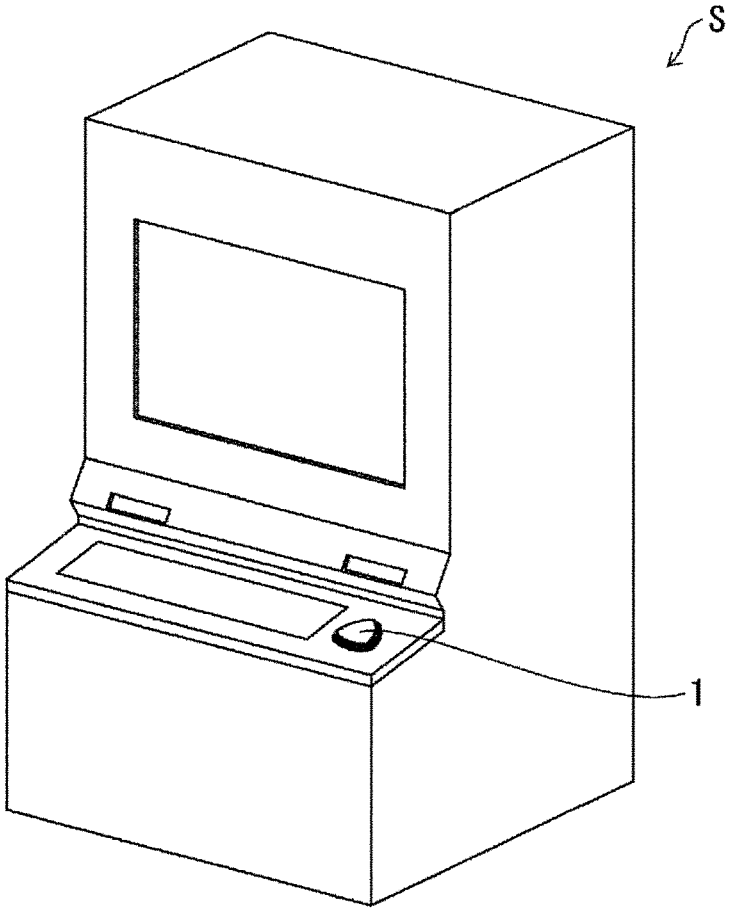
FIG. 1A is a perspective view of a slot machine mounted with a push-button according to a first embodiment of the present invention.
Figure 1B:
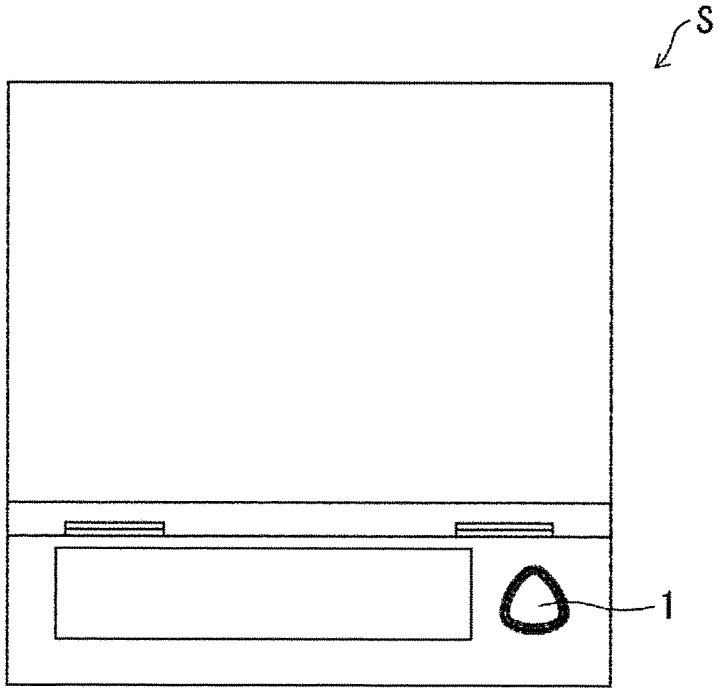
FIG. 1B is a top view of the slot machine.

First, with reference to FIGS. 1A, 1B, 7, and 10, an example of a scene in which the push-button 1 is applied will be described. FIG. 1A is a perspective view of a slot machine S mounted with the push-button 1, and FIG. 1B is a top view of the slot machine S. As illustrated in FIGS. 1A and 1B, in the slot machine S, the push-button 1 is disposed at a position where the push-button 1 is operated by a player.

Figure 7:
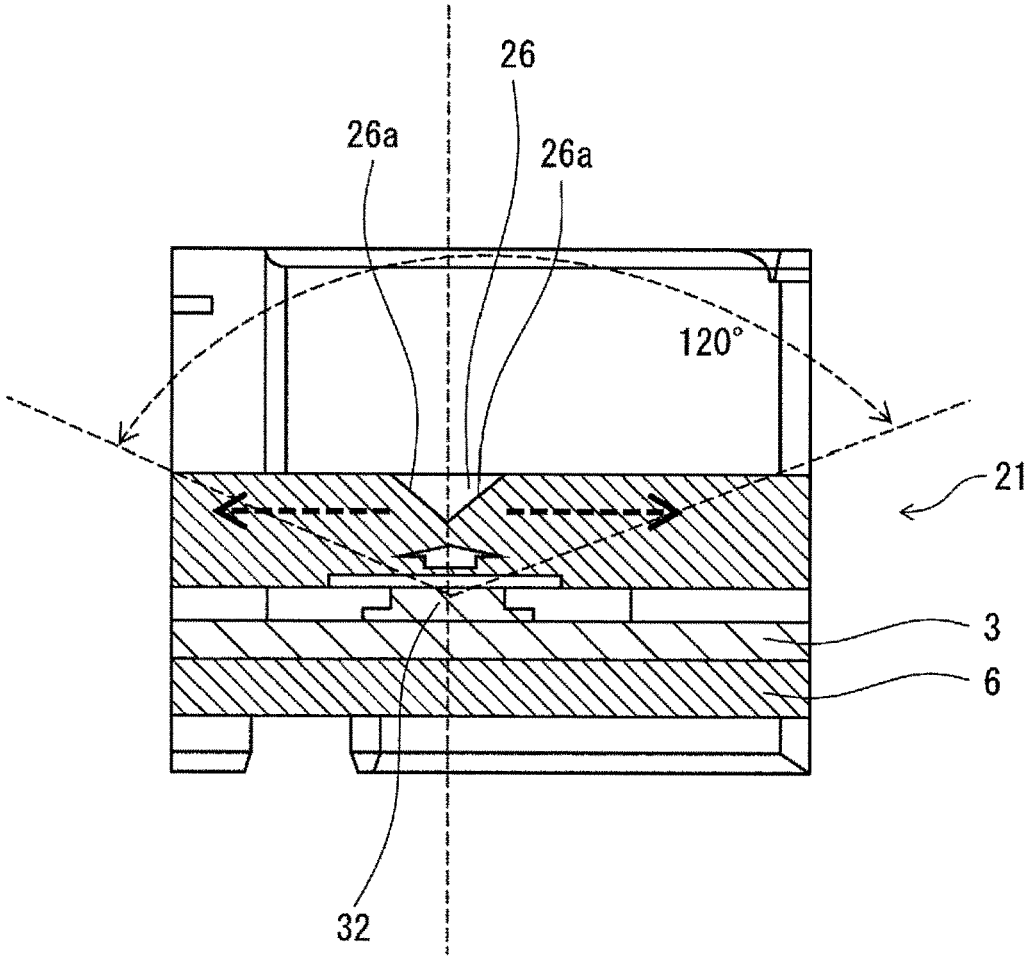
FIG. 7 is a sectional view taken along line A-A illustrated in FIG. 6.
Figure 10:
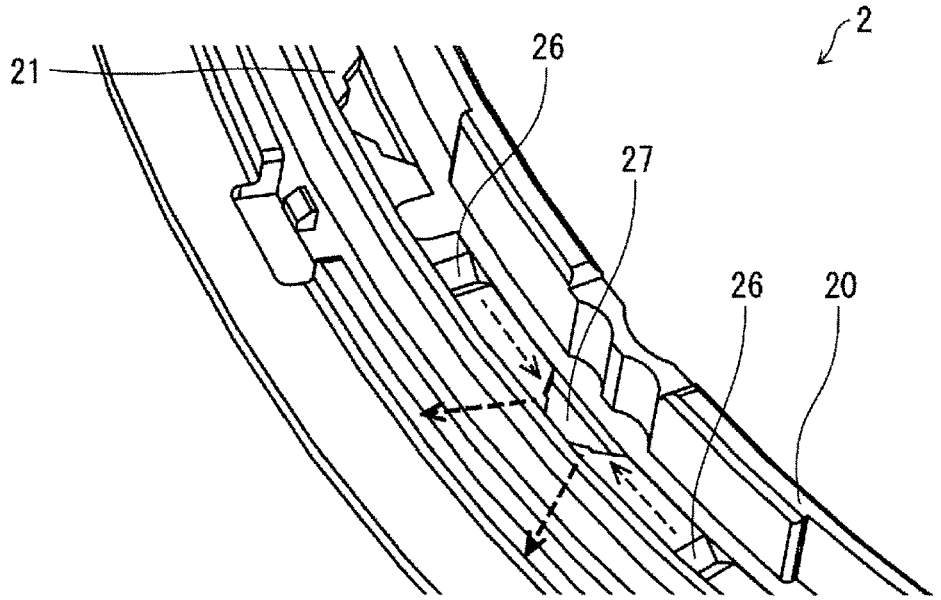
FIG. 10 is an enlarged view of region B in FIG. 6.

The push-button 1 includes a light-emitting diode (LED) 32 (light source), a base 2, and a bezel 5. The base 2 includes a first reflective structure 26 and a second reflective structure 27. As illustrated in FIGS. 7 and 10, in the push-button 1, the first reflective structure 26 in the base 2 reflects light applied from the LED 32, and thereafter, the second reflective structure 27 reflects the light toward the bezel 5. As a result, the bezel 5 having translucency is caused to emit light. That is, light is guided in a direction perpendicular to a vertical direction in the base 2 to cause the bezel 5 to emit light. It is thereby possible to cause the bezel 5 to emit light without increasing the vertical thickness of the push-button 1. In addition, since the light guiding distance of the light from the LED 32 to the bezel 5 can be made long, the light can be applied to the bezel 5, having a large length perpendicular to the vertical direction, over a wide range.

§ 2 Configuration Example

Figure 2:
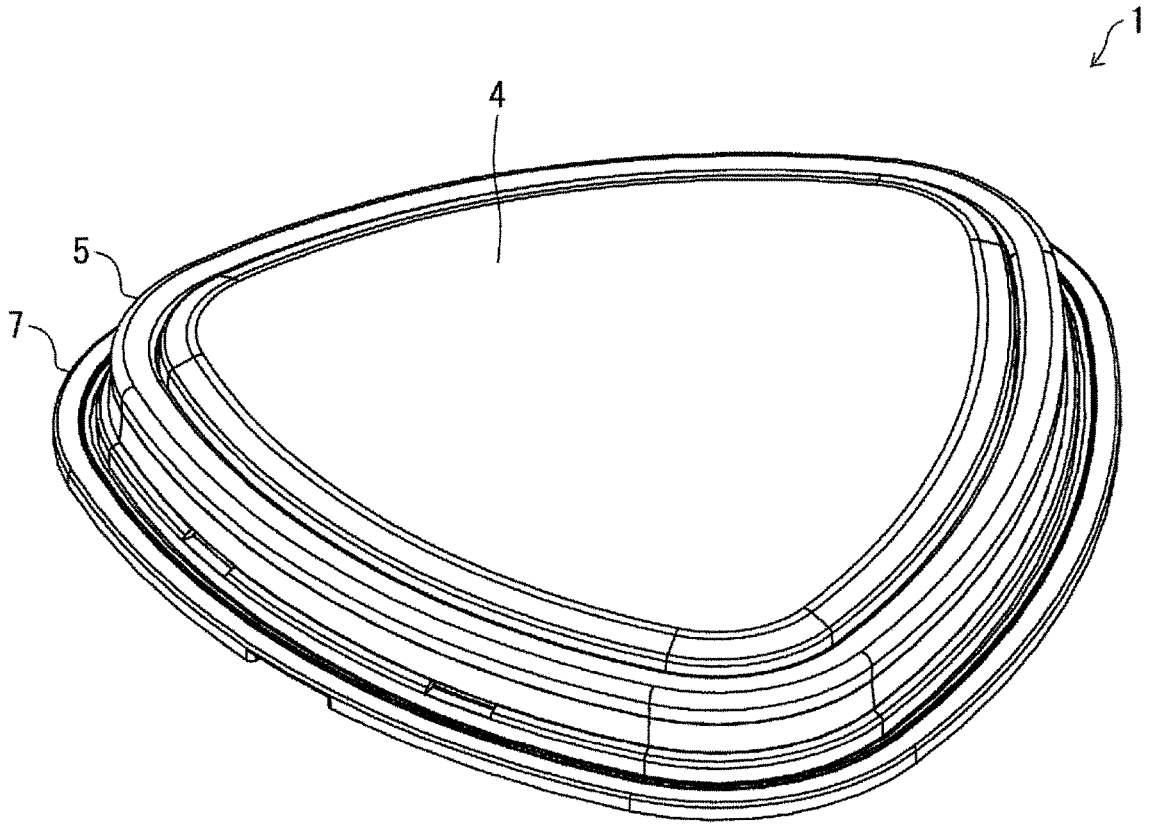
FIG. 2 is a perspective view illustrating an appearance of the push-button.
Figure 3:
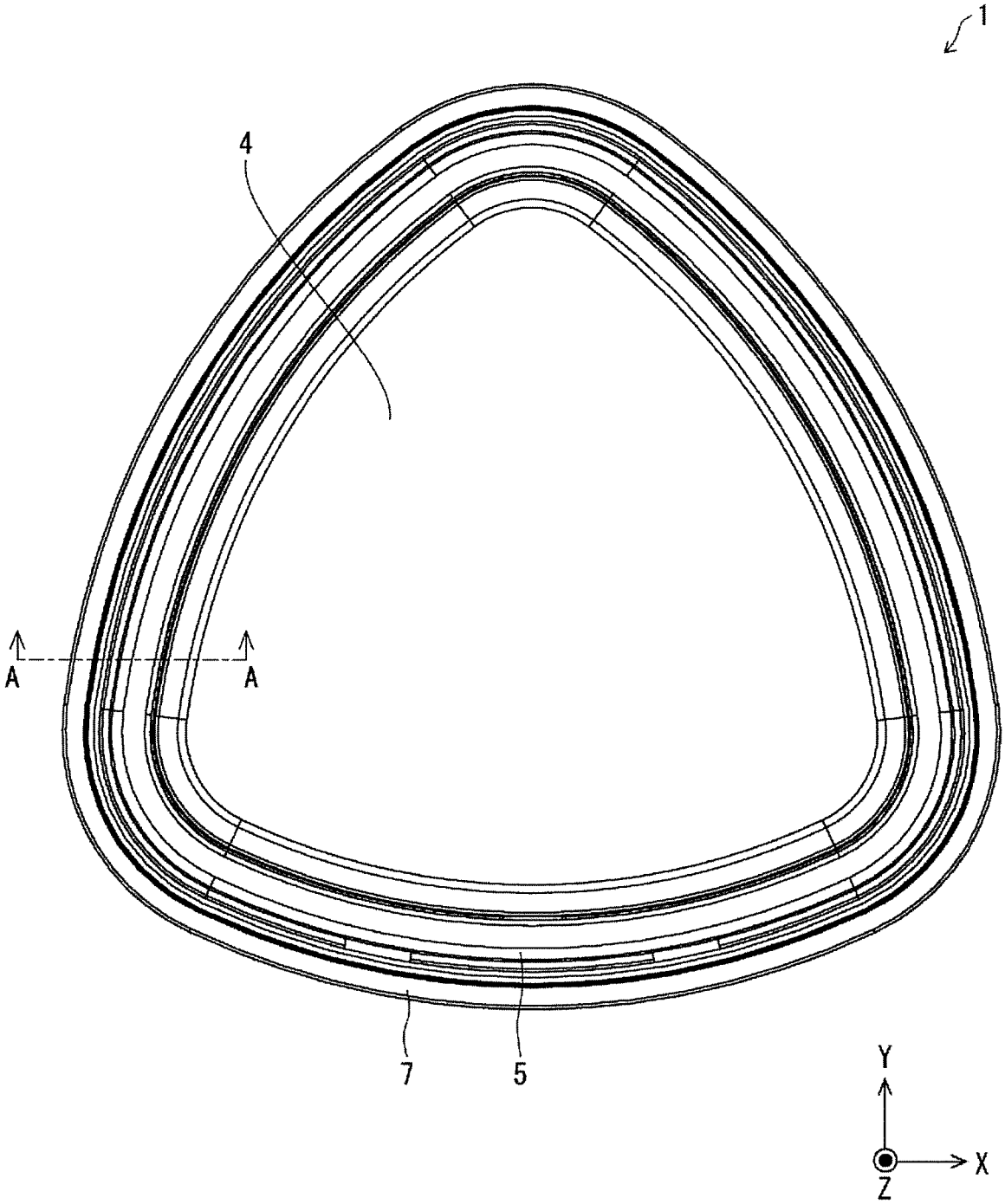
FIG. 3 is a top view of the push-button.
Figure 4:
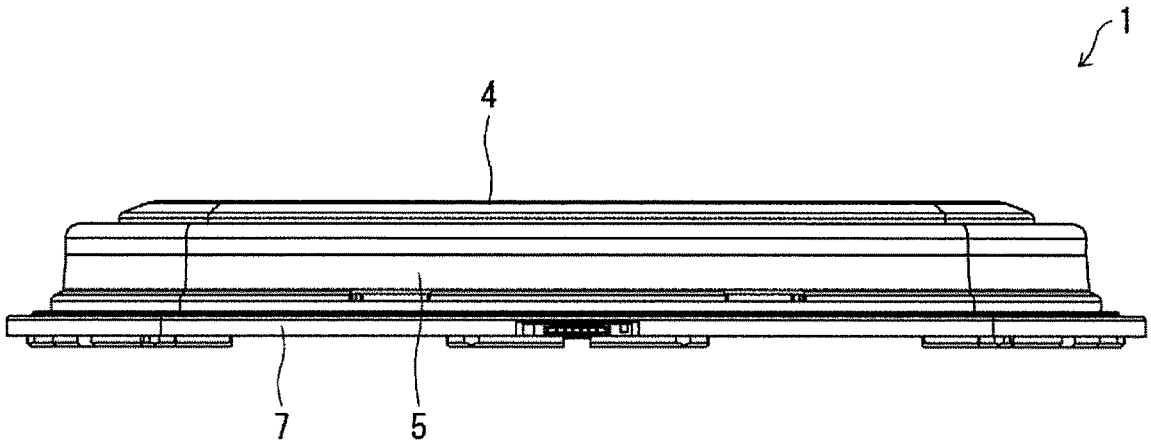
FIG. 4 is a side view of the push-button.
Figure 5:
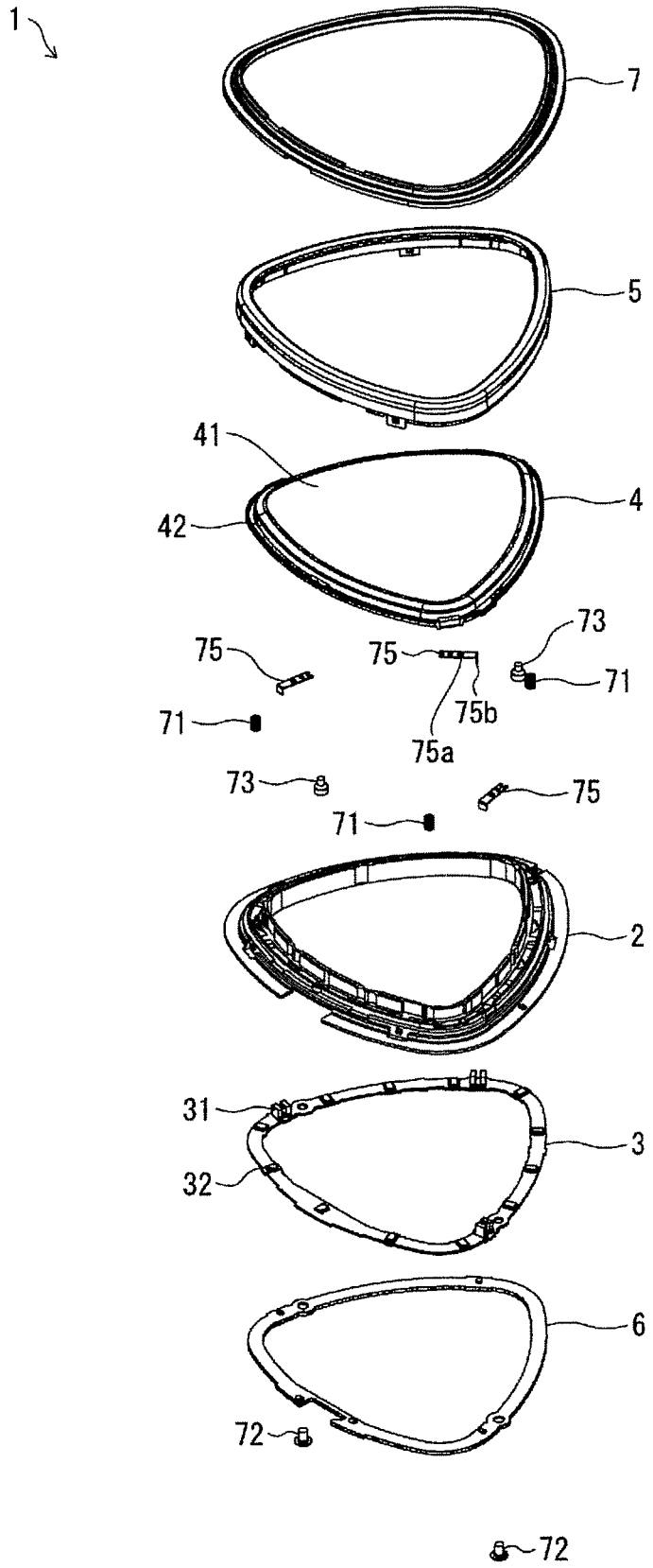
FIG. 5 is an exploded perspective view of the push-button.

The configuration of the push-button 1 of an aspect of the present disclosure will be described in detail with reference to the drawings. FIG. 2 is a perspective view illustrating the appearance of the push-button 1. FIG. 3 is a top view of the push-button 1. FIG. 4 is a side view of the push-button 1. FIG. 5 is an exploded perspective view of the push-button 1. In the following, for convenience of description, a +X direction in FIG. 3 may be described as a right direction, a −X direction as a left direction, a +Y direction as a back direction, a −Y direction as a front direction, a +Z direction as an up direction, a −Z direction as a down direction.

As illustrated in FIG. 3, the push-button 1 has a substantially triangular shape in a plan view from above. However, the push-button of the present invention is not limited to the configuration to have a substantially triangular shape in a plan view from above, and may have a polygonal shape such as a quadrangle or a circular shape in a plan view from above. As illustrated in FIGS. 2 to 5, the push-button 1 includes the base 2, a printed circuit board (PCB, substrate) 3, a key top 4 (operation key), the bezel 5 (side surface portion), a back cover 6, and a waterproof packing 7.

Figure 6:
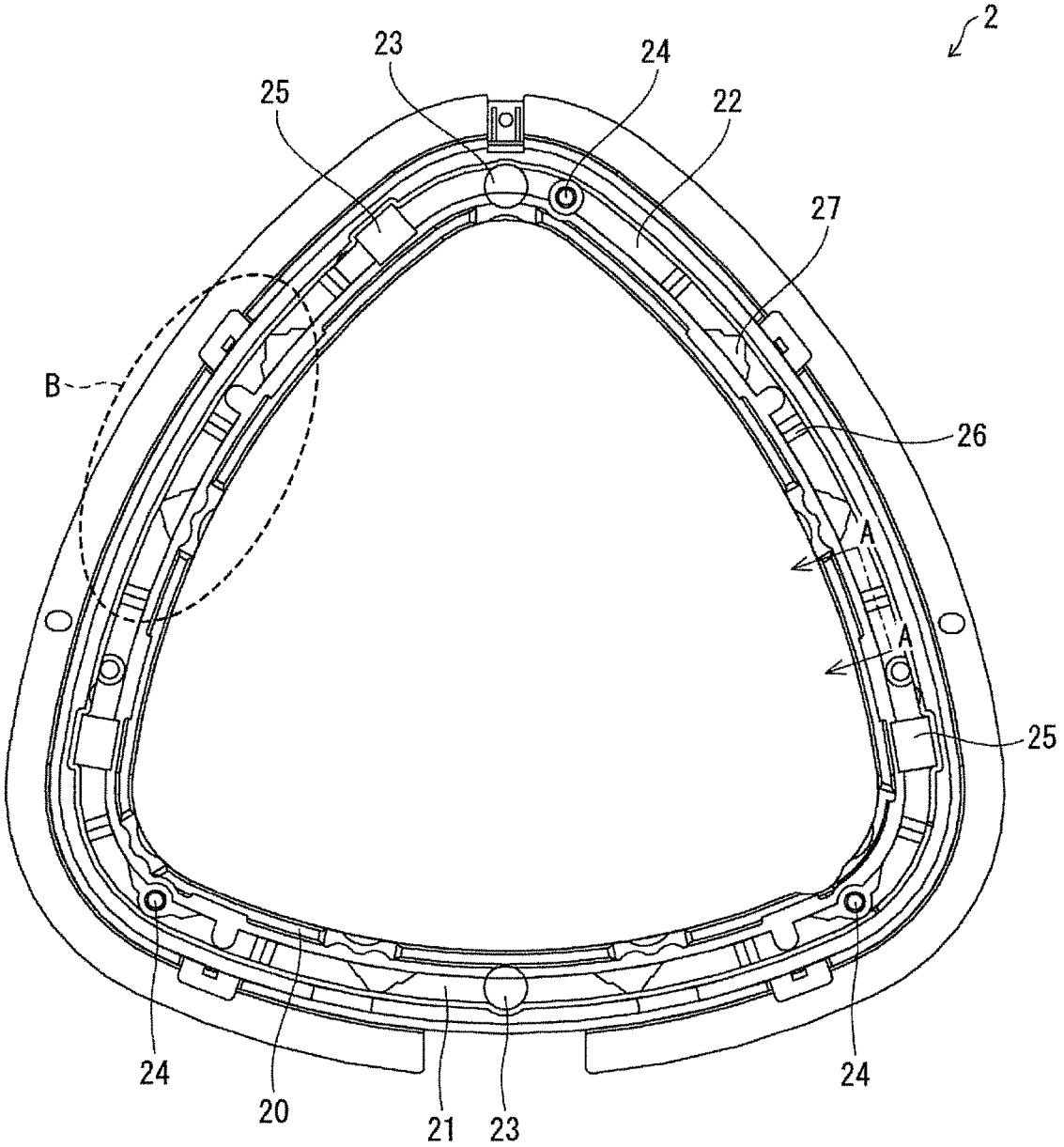
FIG. 6 is a top view of a base included in the push-button.

FIG. 6 is a top view of the base 2. The base 2 is a member for supporting the key top 4, the bezel 5, and the waterproof packing 7. As illustrated in FIGS. 5 and 6, the base 2 has an inner wall 20 and an outer periphery 21 (light guiding portion).

The inner wall 20 is a wall provided inside the base 2 and extending vertically from the outer periphery 21. The inner wall 20 is formed in a substantially triangular shape as viewed from above. On the inner side of the inner wall 20, a central portion 41 of the key top 4, described later, is housed movably in the vertical direction (see FIG. 11). The inner wall 20 has a light shielding property.

The outer periphery 21 surrounds the outer periphery of the inner wall 20 and has a substantially triangular shape as viewed from above. The outer periphery 21 has translucency. As illustrated in FIG. 6, on an upper surface 22 of the outer periphery 21, two rubber receivers 23, and three spring receivers 24 are formed.

The rubber receiver 23 is provided at a position facing a rubber receiver 43 of the key top 4, described later, on the upper surface 22 and has a circular flat surface. The spring receiver 24 is a columnar member projecting upward from the upper surface 22. In the spring receiver 24, a spring 71 is inserted.

In addition, as illustrated in FIG. 6, the outer periphery 21 is formed with an opening 25 opened in the vertical direction in a region corresponding to a place where a sensor 31 of the PCB 3, described later, is formed.

Further, on the upper surface 22 of the outer periphery 21, the first reflective structure 26 and the second reflective structure 27 are formed.

FIG. 7 is a sectional view taken along line A-A illustrated in FIG. 6. As illustrated in FIGS. 6 and 7, the first reflective structure 26 is a V-shaped groove formed so as to project downward from the upper surface 22 of the outer periphery 21. As illustrated in FIG. 6, the first reflective structure 26 is formed from the inside to the outside of the base 2. The first reflective structure 26 is formed above a region where the LED 32, described later, is installed in the PCB 3. As illustrated in FIG. 7, the first reflective structure 26 has two reflective surfaces 26*a*. In the push-button 1 in the embodiment, ten first reflective structures 26 are formed on the outer periphery 21.

As illustrated in FIG. 6, the second reflective structure 27 is formed by recessing the upper surface 22 of the outer periphery 21 downward, and has a mountain shape projecting from the inside toward the outside of the base 2.

Figure 8:
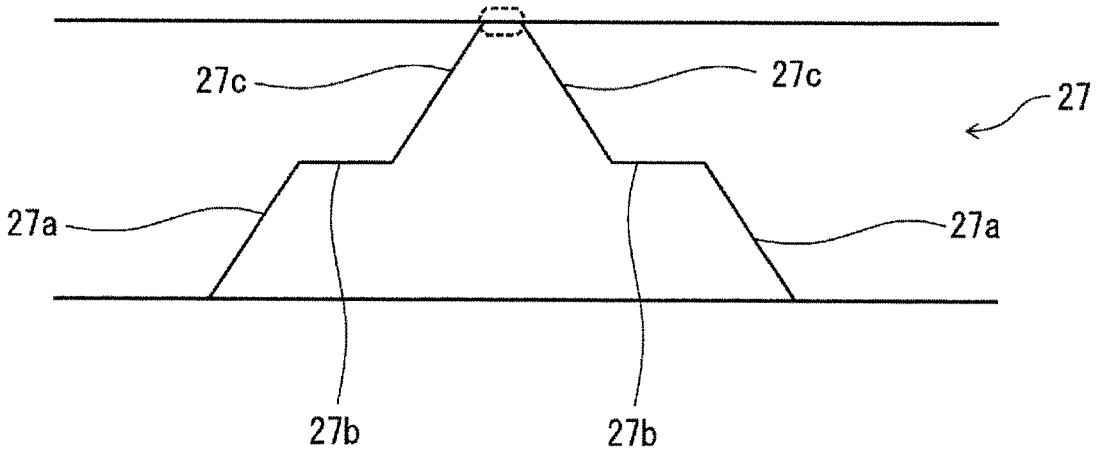
FIG. 8 is a plan view illustrating a configuration of a second reflective structure included in the base.

FIG. 8 is a plan view illustrating the configuration of the second reflective structure 27. The second reflective structure 27 has a symmetrical shape with respect to a plane parallel to the vertical direction from the inside to the outside of the base 2. As illustrated in FIG. 8, on each of the left and right sides from the inside to the outside, the second reflective structure 27 has a first surface 27*a* (first reflective surface), a second surface 27*b*, and a third surface 27*c* (second reflective surface) which are planes parallel to the vertical direction. The first surface 27*a* and the third surface 27*c* are formed obliquely at the same angle with respect to a plane extending from the inside to the outside of the base 2. The second surface 27*b* is formed perpendicularly to the plane extending from the inside to the outside of the base 2. The second surface 27*b* connects the first surface 27*a* and the third surface 27*c*.

As illustrated in FIG. 5, the PCB 3 has a substantially triangular shape as viewed from above. The PCB 3 is disposed so as to be in contact with the lower surface of the base 2. The PCB 3 is a substrate on the upper surface of which three sensors 31 and twelve light emitting diodes (LEDs) 32 as light sources are mounted. The sensor 31 and the LED 32 are electrically connected to the PCB 3. The PCB 3, together with the back cover 6, is fixed to the lower surface of the base 2 by using screws 72.

The sensor 31 is a sensor for detecting that the key top 4 has been pressed by the player, and in the embodiment, the sensor 31 is a photosensor. The three sensors 31 are provided on the top of the PCB 3. The sensor 31 is substantially U-shaped having an opening opened upward. A method for detecting a press of the key top 4 by the sensor 31 will be described later. The result detected by the sensor 31 is output to a controller (not illustrated) of the push-button 1 through the PCB 3.

The LED 32 is a light emitting unit for causing the bezel 5, described later, to emit light. The twelve LEDs 32 are provided on the top of the PCB 3 at substantially the same intervals. As illustrated in FIG. 7, the LED 32 applies light upward. A detail of the light emission of the bezel 5 by using the LED 32 will be described later.

The key top 4 is an operation key for accepting an operation (press) by a player. As illustrated in FIG. 5, the key top 4 includes the central portion 41 and a side surface portion 42.

The shape of the central portion 41 in a plan view from above is substantially the same as that of a region surrounded by the inner wall 20 of the base 2. The central portion 41 has translucency. In the push-button 1, with the central portion 41 having translucency, when a liquid crystal display (LCD) (not illustrated) is disposed below the push-button 1, the player can view an image of the LCD. Note that the LCD displays display information such as characters and symbols in a region facing the key top 4.

Figure 11:
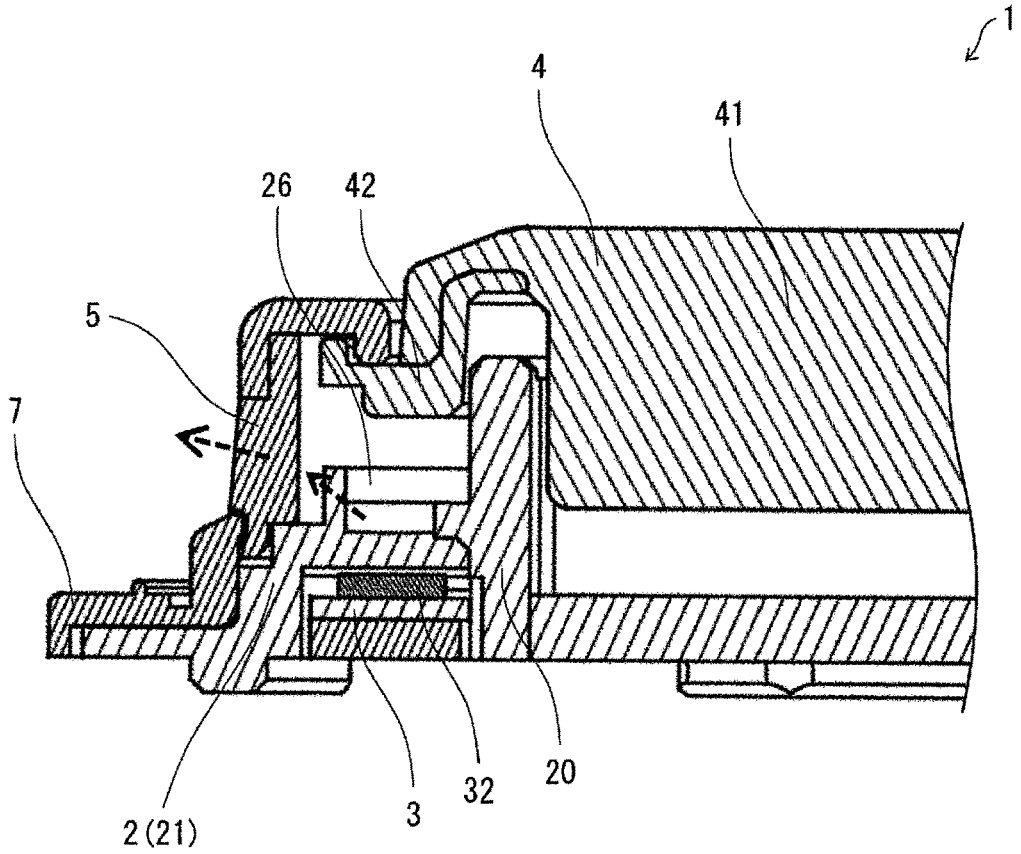
FIG. 11 is a sectional view taken along line A-A illustrated in FIG. 3.

The side surface portion 42 is provided around the central portion 41 and has a substantially L-shaped cross section taken along a cross section perpendicular to the horizontal direction (see FIG. 11). A recess, into which the inner wall 20 of the base 2 is inserted, is formed between the central portion 41 and the side surface portion 42. The side surface portion 42 is separated from the base 2 by a predetermined distance (at least a distance by which the key top 4 is pushed from the player) in a state where the key top 4 is not pressed by the player.

Figure 9:
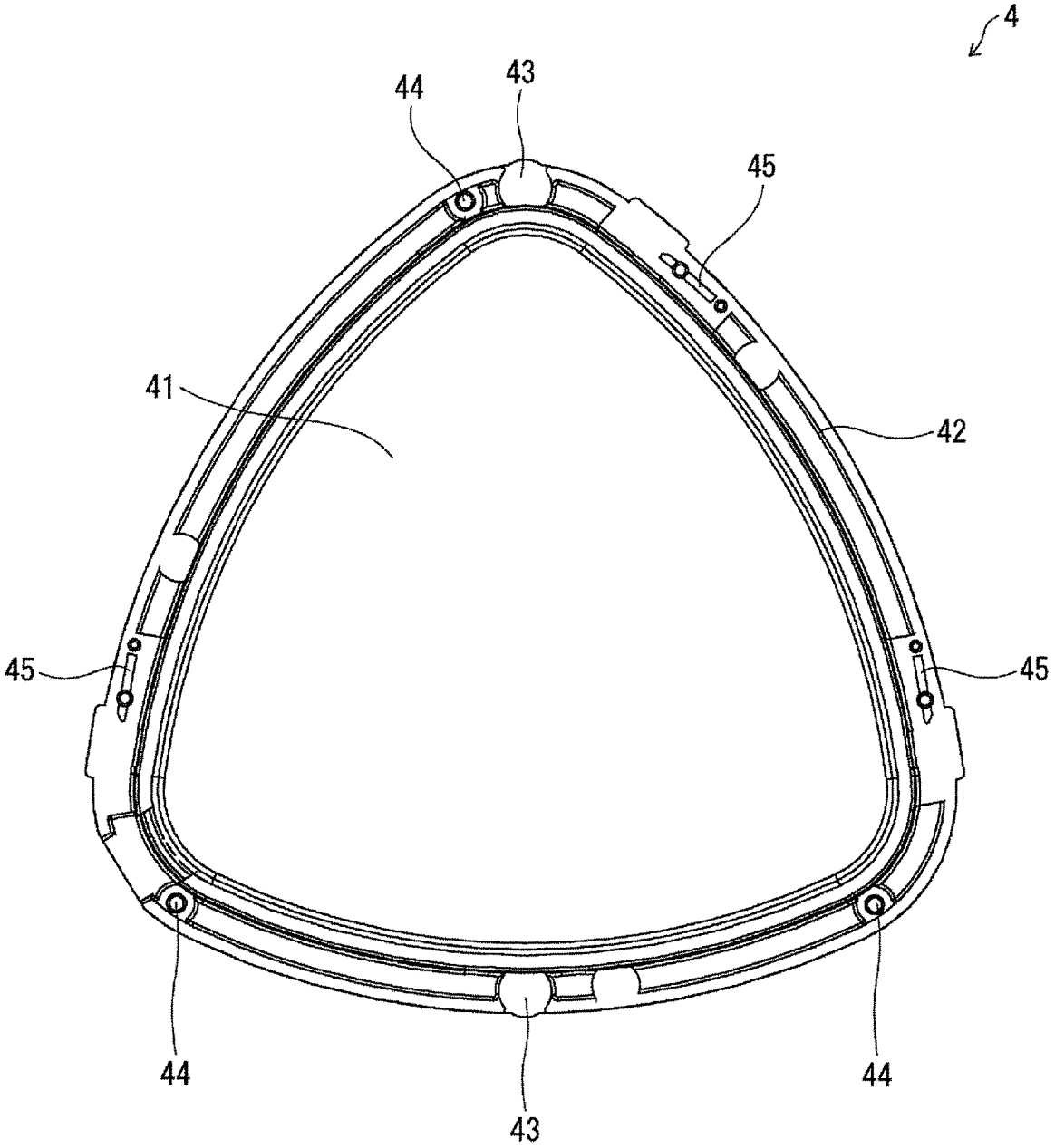
FIG. 9 is a plan view of a key top included in the push-button as viewed from below.

FIG. 9 is a plan view of the key top 4 as viewed from below. As illustrated in FIG. 9, two rubber receivers 43, three spring receivers 44, and three plate attachment portions 45 are provided on the lower surface of the side surface portion 42.

The rubber receiver 43 is provided at a position facing the rubber receiver 23 of the base 2, and has a circular flat surface. As illustrated in FIG. 5, a rubber 73 is inserted between the rubber receiver 43 and the rubber receiver 23 of the base 2.

The spring receiver 44 is a columnar member projecting downward from the lower surface of the side surface portion 42. The spring 71 is inserted between the spring receiver 44 and the spring receiver 24 of the base 2. With the above configuration, the spring 71 applies an urging force to the key top 4 upward, and when the player is not pressing the key top 4, the key top 4 is held in a pushed-up state.

The plate attachment portion 45 is a member to which a plate 75 is attached, the plate 75 detecting that the key top 4 has been pressed by the sensor 31. The plate 75 is provided with a base portion 75*a* that is attached to the plate attachment portion 45 and a bent portion 75*b* formed by bending the end of the base portion 75*a*.

Here, a description will be given of an operation in the push-button 1 at the time when the player presses the key top 4. When the player presses the key top 4, first, the key top 4 moves downward against the urging force of the spring 71. As a result, the plate 75 moves downward, and the bent portion 75*b* of the plate 75 moves between the openings of the sensor 31. Then, the sensor 31 detects the bent portion 75*b*, thereby detecting that the player has pressed the key top 4. In addition, as described above, the rubber 73 is inserted between the rubber receiver 43 of the key top 4 and the rubber receiver 23 of the base 2, and hence a click feeling can be given to the player when the player presses the key top 4.

The bezel 5 has translucency and is a cover member for covering (protecting) a part of the upper surface and the side surface of the push-button 1. The bezel 5 is provided in a region around the key top 4 in a direction parallel to the vertical direction. The bezel 5 has an opening at the center. Hence the key top 4 projects to the upper side of the bezel 5 through the opening, and the key top 4 is loosely fitted in a pressable manner. Further, the bezel 5 is a diffusing material and diffuses the applied light.

The waterproof packing 7 is installed outside the bezel 5 and is a member for preventing water from entering the PCB 3.

§ 3 Operation Example

Next, the light guiding path of the light emitted from the LED 32 will be described with reference to FIGS. 7, 10, and 11. FIG. 10 is an enlarged view of region B in FIG. 6. FIG. 11 is a sectional view taken along line A-A illustrated in FIG. 3. FIG. 11 is a sectional view taken along a plane passing through an optical axis center of the LED 32.

First, as illustrated in FIG. 7, the LED 32 applies light upward. More specifically, with the vertical direction as the optical axis, the LED 32 applies light at an irradiation angle of 60° (120° in total) on both sides of the optical axis in a direction parallel to the bezel 5. The light applied from the LED 32 is incident on the outer periphery 21 of the base 2.

A part of the light incident on the outer periphery 21 of the base 2 is applied to the first reflective structure 26 provided above the LED 32. Note that the first reflective structure 26 is formed in a region including the optical axis center of the LED 32. As illustrated in FIGS. 7 and 11, the light applied to the first reflective structure 26 is reflected by the reflective surface 26*a* of the first reflective structure 26 in a direction parallel to the bezel 5 and perpendicular to the vertical direction (the pressing direction of the key top 4) (a horizontal direction in FIG. 7). In other words, the light applied to the first reflective structure 26 is reflected at an angle different from an angle at which the light is applied to the first reflective structure 26. Note that the direction of the light reflected by the reflective surface 26*a* of the first reflective structure 26 does not have to be completely parallel to the bezel 5 and perpendicular to the vertical direction, and some angular deviation is permitted.

Next, as illustrated in FIG. 10, the light reflected by the reflective surface 26*a* of the first reflective structure 26 is guided inside the outer periphery 21 and reaches the adjacent second reflective structure 27. The light reached the second reflective structure 27 is reflected toward the outside (i.e., toward the bezel 5) by each of the first surface 27*a* and the third surface 27*c* of the second reflective structure 27. The light reflected by each of the first surface 27*a* and the third surface 27*c* is transmitted through the bezel 5 and is emitted to the outside. Hence it is possible to cause the bezel 5 to emit light. In a region where the second reflective structure 27 and the bezel 5 are in contact (a region surrounded by a dotted line in FIG. 8), the bezel 5 is caused to emit light not by the light reflection by the second reflective structure 27 but by the light transmitted through the second reflective structure 27.

As described above, in the push-button 1, the light applied from the LED 32 is reflected by the first reflective structure 26 and the second reflective structure 27 formed on the outer periphery 21 of the base 2 to cause the bezel 5 to emit light. That is, the light is guided in the direction perpendicular to the vertical direction and parallel to the bezel 5 to cause the bezel 5 to emit light. It is thereby possible to cause the bezel 5 to emit light without increasing the vertical thickness of the push-button 1. In addition, since the light guiding distance of the light from the LED 32 to the bezel 5 can be made long, the light can be applied to the bezel 5, having a large length perpendicular to the vertical direction, over a wide range.

In the push-button 1, the first reflective structure 26 reflects a part of the light applied from the LED 32 in the direction parallel to the bezel 5 and perpendicular to the vertical direction, and the second reflective structure 27 is disposed in a direction parallel to the bezel 5 and perpendicular to the vertical direction with respect to the first reflective structure 26. As a result, a part of the light emitted from the LED 32 can be spread in a direction parallel to the bezel 5, and can thereafter be reflected toward the bezel 5. As a result, it is possible to apply the light to the bezel 5, having a large length perpendicular to the vertical direction, over a wide range. The "parallel direction" or the "vertical direction" described above need not be perfectly parallel or perpendicular, and some deviation is permitted.

Further, in the push-button 1, in a region to which the light is applied from the LED 32 (hereinafter referred to as a light irradiation region), the first reflective structure 26 is formed in a partial region being smaller than the light irradiation region and including the optical axis center of the light emitted from the LED 32. Thus, among the light emitted from the LED 32, light having not been applied to the first reflective structure 26 is applied to the upper surface 22 of the outer periphery 21 of the base 2, and is applied from the bezel 5 to the outside in the vicinity of the LED 32. As a result, a part of the light emitted from the LED 32 is reflected by the second reflective structure 27 and emitted from the bezel 5 to the outside (i.e., emitted from a position distant from the LED 32 to the outside), and the other light emitted from the LED 32 is emitted to the outside in the vicinity of the LED 32. That is, it is possible to cause the bezel 5 to emit light uniformly.

Further, as described above, the second reflective structure 27 includes the first surface 27*a* and the third surface 27*c*, and the distance from the first reflective structure 26 to the first surface 27*a* is smaller than the distance therefrom to the third surface 27*c*. As a result, the light reflected by the first surface 27*a* is reflected to the light toward the bezel 5 in a region close to the first reflective structure 26 as compared to the light reflected by the third surface 27*c*. That is, the light reflected by the first surface 27*a* and the light reflected by the third surface 27*c* enable light emission over a wider range of the bezel 5.

Further, one second reflective structure 27 is provided between the first reflective structures 26 adjacent to each other. It is thus possible to make the base 2 structurally simple as compared to the case of providing a plurality of reflective structures for reflecting the light reflected by the first reflective structure 26 toward the bezel 5.

Further, as described above, the bezel 5 is made of a diffusing material, diffuses the light reflected by the second reflective structure 27 and applies the light to the outside. Hence the bezel 5 can be caused to emit light more uniformly.

In addition, the inner wall 20 of the base 2 has a light shielding property. This prevents leakage of the light applied from the LED 32 to the inside of the base 2 (i.e., in the direction to the key top 4).

In the aspect of the embodiment, the LED 32 applies light upward, but the push-button for the game machine of the present invention is not limited thereto. For example, in some aspect of the embodiment, separately from the PCB 3 on which the sensor 31 is placed, a PCB mounted with the LED 32 may be provided and installed on the top of the base 2, and the LED 32 may apply light downward. However, in this case, it is necessary to provide the first reflective structure and the second reflective structure on the lower surface of the outer periphery 21.

§ 4 Modified Example

Next, a push-button 1A as a modified example of the push-button 1 will be described. For convenience of description, members having the same functions as the members described in the above embodiment are denoted by the same reference numerals, and the description thereof will not be repeated.

Figure 12:
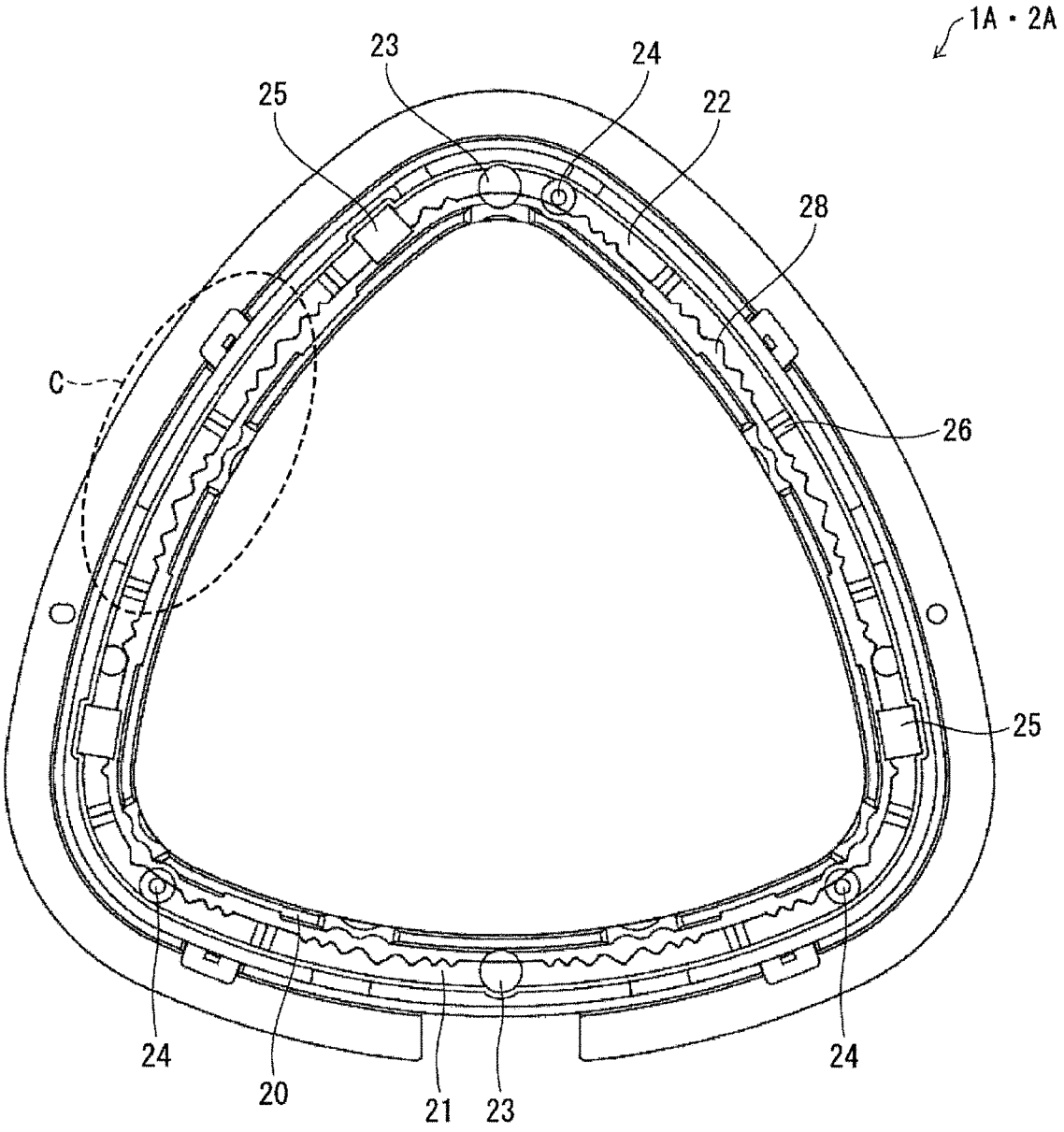
FIG. 12 is a top view of a base included in a push-button as a modified example of the push-button.
Figure 13:
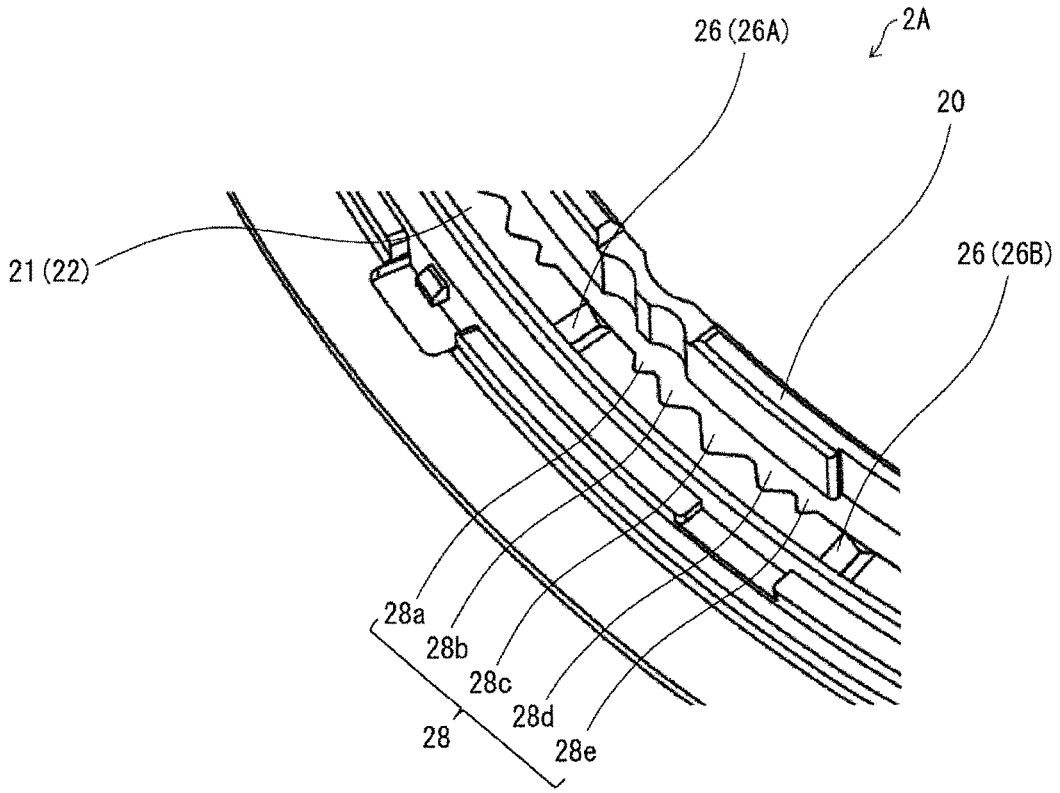
FIG. 13 is an enlarged view of region C in FIG. 12.
Figure 14:
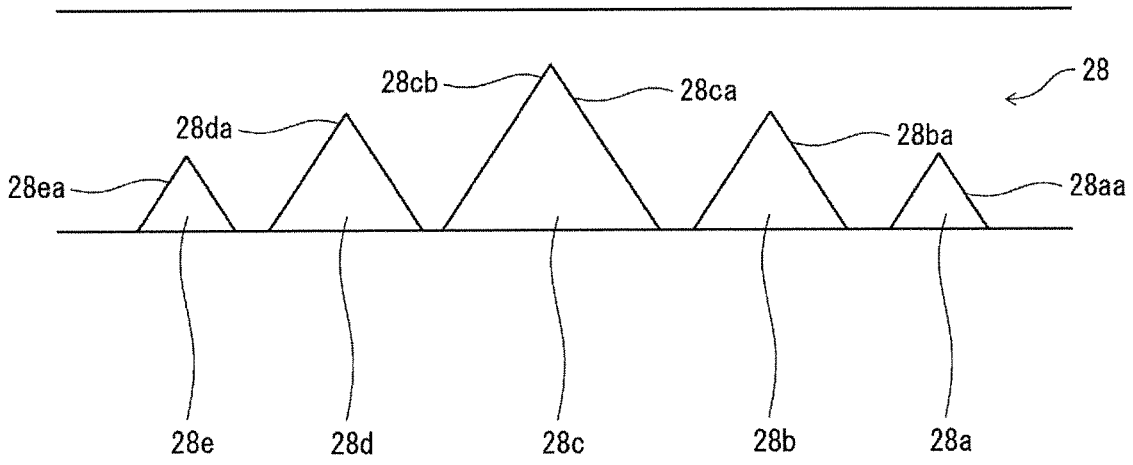
FIG. 14 is a plan view illustrating a configuration of a second reflective structure included in the push-button as the modified example.

FIG. 12 is a top view of a base 2A included in the push-button 1A. FIG. 13 is an enlarged view of region C in FIG. 12. FIG. 14 is a plan view illustrating a configuration of a second reflective structure 28.

As illustrated in FIG. 12, the push-button 1A includes the base 2A instead of the base 2 in the first embodiment. The base 2A includes the second reflective structure 28 in place of the second reflective structure 27 in the first embodiment.

As illustrated in FIGS. 13 and 14, the second reflective structure 28 is formed by recessing the upper surface 22 of the outer periphery 21 downward. The second reflective structure 28 is made up of five reflective structures 28*a*, 28*b*, 28*c*, 28*d*, 28*e*, each having a substantially triangular shape and projecting from the inside toward the outside of the base 2.

The reflective structure 28*c* is formed to be larger than the reflective structures 28*a*, 28*b*, 28*d*, 28*e*, and the reflective structures 28*b*, 28*d* are formed to be larger than the reflective structures 28*a*, 28*e*.

The reflective structures 28*a*, 28*b*, 28*c* respectively have reflective surfaces 28*aa*, 28*ba*, 28*ca* for each reflecting the light guided from the right side toward the outside (i.e., toward the bezel 5) in FIG. 14. Further, the reflective structures 28*c*, 28*d*, 28*e* respectively have reflective surfaces 28*ca*, 28*da*, 28*ea* for each reflecting the light guided from the left side toward the outside in FIG. 14.

With the above configuration, in the push-button 1A, the light applied from the LED 32 and reflected by the first reflective structure 26 is reflected by the reflective structures 28*a*, 28*b*, 28*c*, 28*d*, 28*e* of the second reflective structure 28 toward the outside (i.e., toward the bezel 5). Hence it is possible to cause the bezel 5 to emit light.

Moreover, the reflective surfaces 28*aa*, 28*ba*, 28*ca* have mutually different distances from the first reflective structure 26. As a result, it is possible to apply the light to the bezel 5, having a large length perpendicular to the vertical direction, over a wide range. That is, it is possible to cause the bezel 5 to emit light uniformly.

The present invention is not limited to each of the embodiments described above, but can be subjected to a variety of changes in the scope shown in the claims. An embodiment obtained by appropriately combining technical units disclosed respectively in different embodiments is also included in a technical scope of the present invention.

The invention claimed is:

1. A push-button for a game machine which is mounted on the game machine, the push-button comprising:

an operation key configured to accept a press;

a side surface portion having translucency and provided in a direction vertical to a pressing direction of the operation key as viewed from the operation key;

a light source configured to apply light in a direction parallel to the pressing direction; and a light guiding portion configured to guide light applied from the light source, wherein the light guiding portion includes:

a first reflective structure configured to reflect at least a part of the light applied from the light source, and a second reflective structure configured to reflect at least a part of the light reflected by the first reflective structure toward the side surface portion, wherein the side surface portion includes:

a first member configured to protect a part of an upper surface of the push-button; and a second member configured to protect a side surface of the push-button, and wherein the light reflected by the second reflective structure is emitted to an outside through the second member.

2. The push-button for the game machine according to claim 1, wherein the first reflective structure reflects at least a part of the light applied from the light source in a direction parallel to the side surface portion and vertical to the pressing direction, and wherein the second reflective structure is disposed in a direction parallel to the side surface portion and vertical to the pressing direction with respect to the first reflective structure.

3. The push-button for the game machine according to claim 2, wherein in a light irradiation region to which the light is applied from the light source, the first reflective structure is provided in a partial region being smaller than the light irradiation region and including an optical axis center of the light emitted from the light source.

4. The push-button for the game machine according to claim 2, wherein the second reflective structure includes a first reflective surface and a second reflective surface, and wherein the first reflective surface and the second reflective surface reflect the light reflected by the first reflective structure in an identical direction, and have mutually different distances from the first reflective structure.

5. The push-button for the game machine according to claim 2, wherein the light guiding portion includes a plurality of the first reflective structures, and wherein one second reflective structure identical to the second reflective structure is provided between two adjacent first reflective structures of the plurality of the first reflective structures.

6. The push-button for the game machine according to claim 2, wherein the side surface portion diffuses the light reflected by the second reflective structure and applies the light to an outside.

7. The push-button for the game machine according to claim 1, wherein in a light irradiation region to which the light is applied from the light source, the first reflective structure is provided in a partial region being smaller than the light irradiation region and including an optical axis center of the light emitted from the light source.

8. The push-button for the game machine according to claim 7, wherein the second reflective structure includes a first reflective surface and a second reflective surface, and wherein the first reflective surface and the second reflective surface reflect the light reflected by the first reflective structure in an identical direction, and have mutually different distances from the first reflective structure.

9. The push-button for the game machine according to claim 7, wherein the light guiding portion includes a plurality of the first reflective structures, and wherein one second reflective structure identical to the second reflective structure is provided between two adjacent first reflective structures of the plurality of the first reflective structures.

10. The push-button for the game machine according to claim 7, wherein the side surface portion diffuses the light reflected by the second reflective structure and applies the light to an outside.

11. The push-button for the game machine according to claim 1, wherein the second reflective structure includes a first reflective surface and a second reflective surface, and wherein the first reflective surface and the second reflective surface reflect the light reflected by the first reflective structure in an identical direction, and have mutually different distances from the first reflective structure.

12. The push-button for the game machine according to claim 11, wherein the light guiding portion includes a plurality of the first reflective structures, and wherein one second reflective structure identical to the second reflective structure is provided between two adjacent first reflective structures of the plurality of the first reflective structures.

13. The push-button for the game machine according to claim 11, wherein the side surface portion diffuses the light reflected by the second reflective structure and applies the light to an outside.

14. The push-button for the game machine according to claim 1, wherein the light guiding portion includes a plurality of the first reflective structures, and wherein one second reflective structure identical to the second reflective structure is provided between two adjacent first reflective structures of the plurality of the first reflective structures.

15. The push-button for the game machine according to claim 14, wherein the side surface portion diffuses the light reflected by the second reflective structure and applies the light to an outside.

16. The push-button for the game machine according to claim 1, wherein the side surface portion diffuses the light reflected by the second reflective structure and applies the light to an outside.

* * * * *